US007017759B1

(12) United States Patent
Friend

(10) Patent No.: US 7,017,759 B1
(45) Date of Patent: Mar. 28, 2006

(54) BOTTLE RETAINER

(76) Inventor: Stephen Friend, 12000 Lulu Rd., Ida, MI (US) 48140

( * ) Notice: Subject to any disclaimer, the term of this patent is extended or adjusted under 35 U.S.C. 154(b) by 0 days.

(21) Appl. No.: 10/674,622

(22) Filed: Sep. 30, 2003

(51) Int. Cl.
*A47B 73/00* (2006.01)

(52) U.S. Cl. ..... 211/75; 248/312

(58) Field of Classification Search ..... 248/312, 248/311.2; 211/75, 76
See application file for complete search history.

(56) References Cited

U.S. PATENT DOCUMENTS

| | | | | | |
|---|---|---|---|---|---|
| 773,366 | A | * | 10/1904 | Bennett | 232/41 E |
| 917,914 | A | * | 4/1909 | Otteren | 248/312 |
| 1,185,509 | A | * | 5/1916 | Kandlbinder | 248/312 |
| 2,921,690 | A | * | 1/1960 | Smith et al. | 211/73 |
| 3,552,612 | A | * | 1/1971 | Greis | 294/87.28 |
| D262,504 | S | * | 1/1982 | Flynn | D6/574 |
| D347,538 | S | * | 6/1994 | Fleischer | D6/567 |
| 5,655,673 | A | * | 8/1997 | Weterrings et al. | 211/75 |
| RE36,827 | E | * | 8/2000 | Belokin et al. | 211/75 |
| 6,120,224 | A | * | 9/2000 | Powell | 410/36 |

FOREIGN PATENT DOCUMENTS

| | | | | |
|---|---|---|---|---|
| CH | 159912 | * | 2/1933 | 248/312 |
| GB | 8986 | * | 5/1895 | 211/74 |

* cited by examiner

*Primary Examiner*—Ramon O Ramirez
(74) *Attorney, Agent, or Firm*—Rader, Fishman & Grauer PLLC

(57) ABSTRACT

A bottle retainer includes a base having an affixing portion and a retaining portion. The affixing portion is adapted to mount the bottle retainer to a surface and the retaining portion is adapted to slidably receive at least one bottle. The retaining portion may further include obstructions for engaging the bottle, whereby accidental disengagement is prevented. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

8 Claims, 2 Drawing Sheets

BOTTLE RETAINER

FIELD OF THE INVENTION

The present invention relates generally to a retainer for holding bottles and more particularly to a retainer that holds medication bottles.

BACKGROUND OF THE INVENTION

Prescription drugs, over-the-counter formulas, vitamins, herbal remedies, medicinal supplements and the like (collectively, "medications") play an ever-increasing role in the daily lives of many people, especially the elderly population. As the pharmaceutical industry evolves, medications are increasingly essential to improving the quality of life for many individuals. Additionally, in many instances, medications lengthen and improve lives, and people depend on these medications for their continued survival. For example, it is not uncommon for a senior citizen to have a blood pressure medication, take at least one vitamin supplement, and resort to various herbal alternatives. As people grow older and their schedules become fraught with doctor visits, etc., the task of organizing these and other medications often becomes burdensome, confusing, and, in particular instances, overwhelming.

The benefits of these various medications are not only received by the elderly population. At one time or another, most people require some medication such as aspirin to fight a headache, or a cold tablet to ward off a cold. The multitude of similar appearing bottles are easily misplaced and often confused.

It would be advantageous, therefore, to have a bottle retainer that enables an individual to more easily manage these and other medications.

There have been various prior art attempts to help an individual organize their various medications. Rather than include the prescription bottle as part of the solution, most prior art attempts have required an individual to remove the tablets from the pill container and sort their various medications by placing them in containers corresponding to the day or date prescribed. While medication sorters and organizers of this type are beneficial, taking medication from a container and inserting it into another is time-consuming. Additionally, liquid and powder based solutions are not conducive to such a technique. Moreover, this can be dangerous. The bottles themselves, in conjunction with the labels attached thereto, generally contain very important information relating to dosage instructions, the prescribing doctor and hospital, the pharmacy information, important interactions with other drugs, and instructions in case of an emergency. The prior art attempt circumvents this important information and because the patient is not required to handle the bottle on a repeated basis they may accidentally lose the bottle, or, even, throw it out. Because the user removes the pill from its original packaging to place it into the pill sorter, medications are often confused, and the dosage instructions are more easily ignored. To alleviate the disadvantages of the prior art, it would be more beneficial, therefore, to generally have the package nearby, and more readily accessible.

There still exists little to no art that offers convenient storage for the bottles and residual pills. Individuals could secure medications, in their original container, within a bottler retainer. This would allow an individual to keep the containers within view and in an organized fashion thereby allowing the individual to be reminded of the important necessity to take their medication. Additionally, the holder could ensure medications are kept in a proper storage environment away from pets, children, and others. The present invention was developed in light of these and other drawbacks.

SUMMARY OF THE INVENTION

To address these and other drawbacks, the present invention provides a bottle retainer that utilizes a base having an affixing portion and a retaining portion. The affixing portion being adapted to affix the bottle retainer to a surface and the retaining portion adapted to slidably receive at least one bottle. Additionally, the retaining portion may further include obstructions for engaging the bottle whereby accidental disengagement is prevented.

Other aspects of the invention will be apparent to those skilled in the art after reviewing the drawings and the detailed description below.

DETAILED DESCRIPTION

Figure 1A:
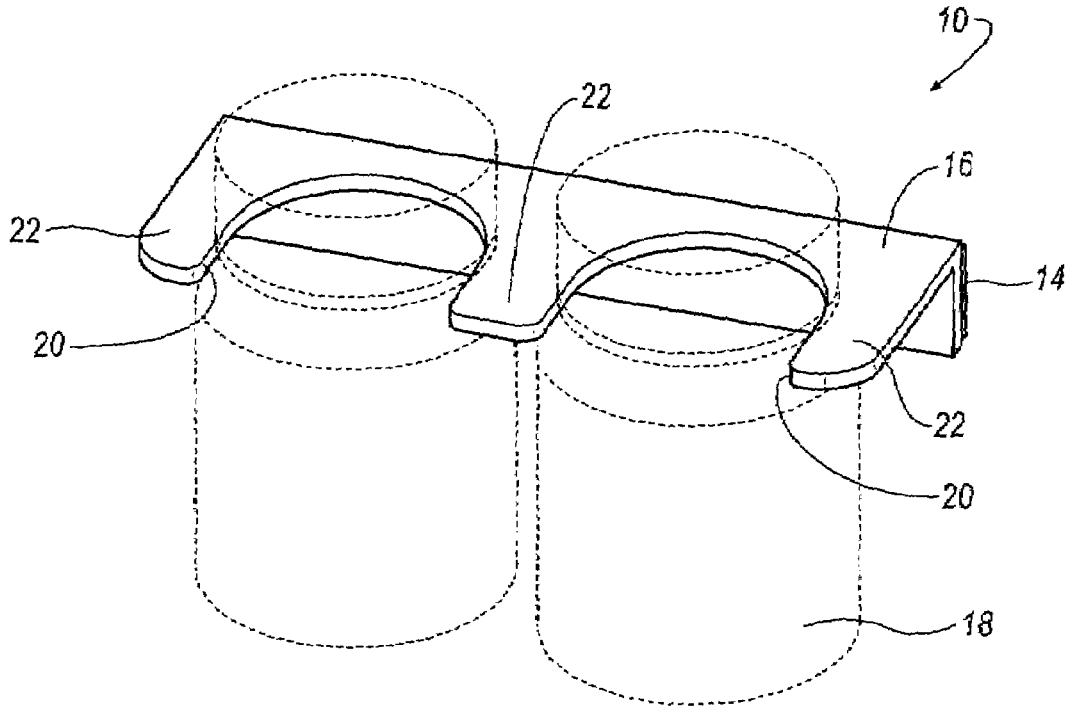
FIG. 1A illustrates a perspective view of an exemplary embodiment of the present invention.

FIG. 1A illustrates an exemplary embodiment in accordance with the present invention. The bottle retainer 10 generally includes a base having an affixing portion 14 extending downward from a retaining portion 16. As illustrated, the portions 14, 16 meet to form substantially an L-shape. In an exemplary embodiment the union of the affixing 14 and retaining 16 portions substantially forms a right angle, although this angle may be modified to further accommodate different angled surfaces for ease of installation, the modification of this feature should be readily apparent to one of ordinary skill in the art. Moreover, in another embodiment the affixing portion 14 may alternately extend upward to form an affixing portion.

In an exemplary embodiment, retaining portion 16 is further configured to slidably receive at least one bottle 18. For illustration purposes only, this may be accomplished by forming an opening 20 having bifurcate arms 22 at either side, wherein the arms 22 are positioned to accept the bottle body and engage the bottle cover thereby suspending the bottle over the opening 20. As seen in the illustrations, the center arms 22, may be shared by the openings 20 located on either side. It is within the purview of this invention, therefore, that there will be n+1 arms, wherein n represent the number of bottles, unless however, the retainer is designed for a single bottle and would require two arms. In an exemplary embodiment the opening 20 is substantially U-shaped wherein the back of the opening is further adapted to substantially abut the bottle resting therein, though, as illustrated in other embodiments herein, the opening 20 may be configured to not substantially abut the bottle. The affixing portion 14 is further configured to affix the bottle retainer 10 to a surface; the features of which will be further described hereinbelow.

Figure 2A:
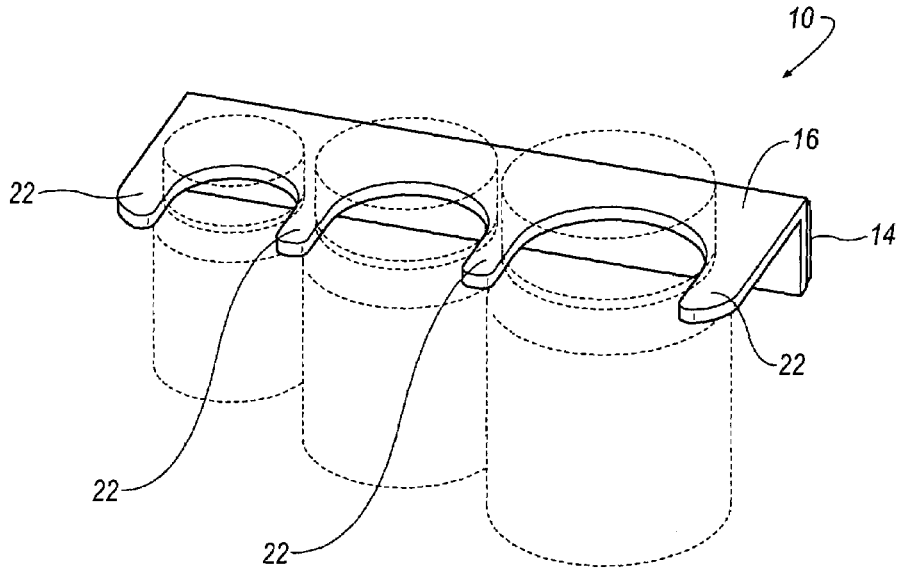
FIG. 2A illustrates a perspective view of yet another exemplary embodiment of the present invention.
Figure 2B:
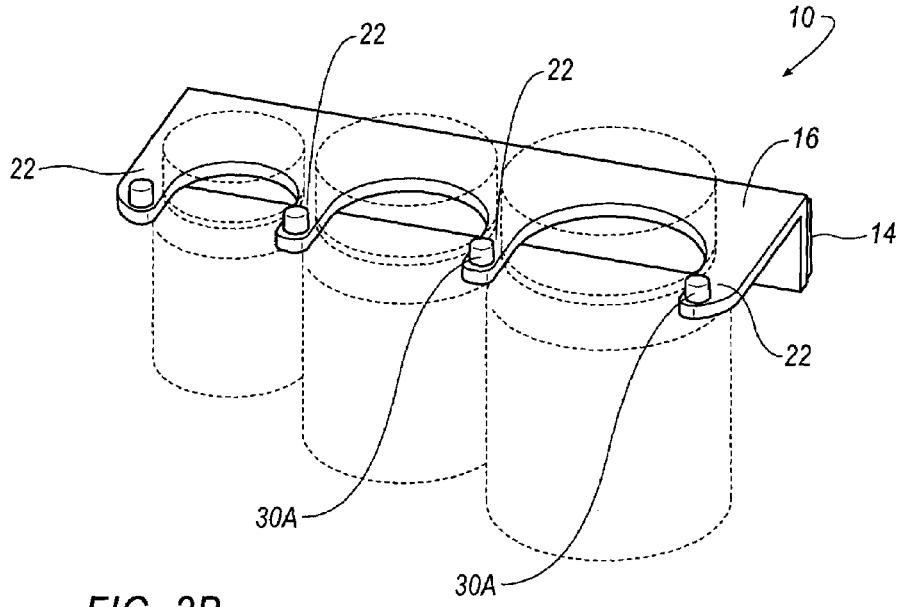
FIG. 2B illustrates a perspective view of yet another exemplary embodiment of the present invention.

The size of the openings 20 may vary dependant upon the needs of the particular user. The invention, therefore, may not be limited to the sizes disclosed in this specification or the attached drawings. In a preferred form, an embodiment of the invention has openings of varying sizes. As illustrated in FIGS. 2A and 2B, the bottle retainer 10 has openings to accommodate smaller, medium, and large sized bottles. In an even more preferred form the openings are further configured to receive bottles of at least four varying sizes. It is within the purview of the present invention, therefore, to include all various combinations of sizes.

Figure 1B:
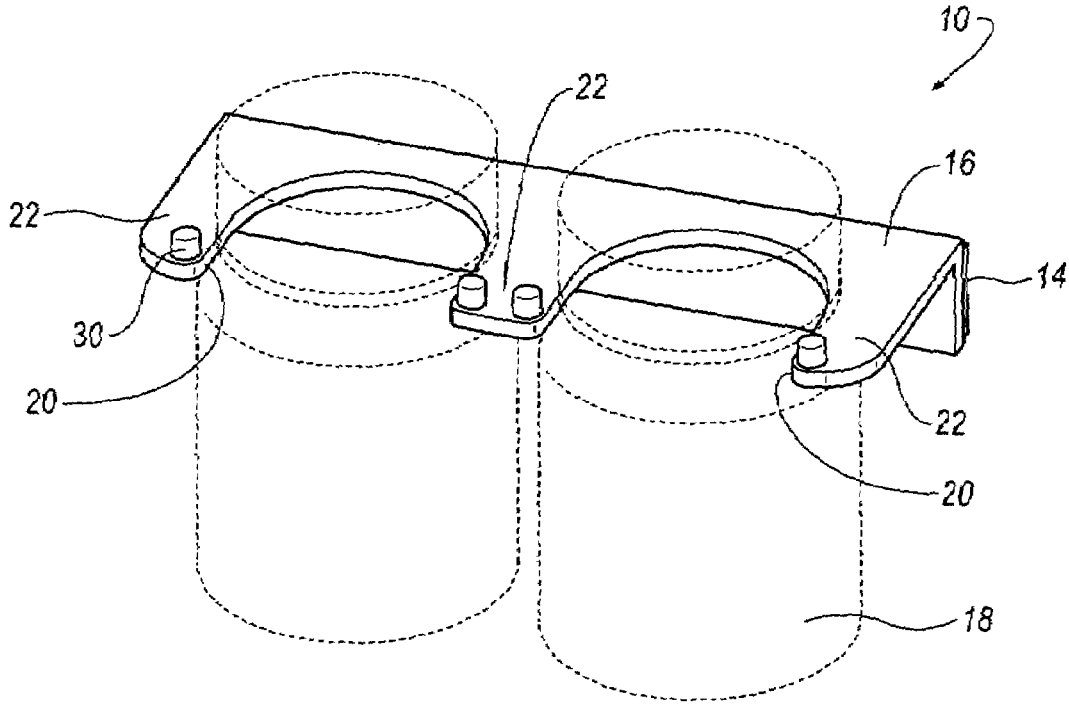
FIG. 1B illustrates a perspective view of another exemplary embodiment of the present invention.

Though not necessary to implement the invention, in certain embodiments as illustrated in FIGS. 1B and 2B, the bifurcate arms 22 may further include at least one obstruction 30, or stopper, at or near the margins of the arms 22, the obstruction being configured to engage the bottle wherein the bottle must be lifted over the obstruction 30 to slidably engage or disengage the bottle. The obstruction 30 may be in the form of a bump, knob, projection, raised or lowered dimple, tit or any other suitable means for restricting movement of the bottle. Moreover, having the obstruction 30 present further helps to secure the bottles within the bifurcate arms 22 thereby preventing accidental engagement or disengagement as the obstruction 30 secures the bottle so that the bottle may only release once a small amount of force is applied to the bottle. In an exemplary embodiment, as illustrated, an obstruction is located at the end of each bifurcate arm such that two obstructions act upon each bottle. In alternate embodiments, however, as seen in FIG. 2B, the central arms may secure the bottles by implementing a single obstruction 30A adapted to engage multiple bottles.

Affixing the bottle retainer 10 may yield a variety of forms and the affixing material may be located at a variety of positions within the system. The bottle retainer 10 may be affixed to nearly any surface, preferably a smooth flat surface. The affixing portion 14 extending from the retaining portion 16 of the bottler holder 10 may be further described having a front side 32 and a back side 34, the back side being configured to mount bottle retainer 10 to a surface. In an exemplary embodiment, the affixing portion 14 is approximately 1 1/16 inches in height as this is the requisite amount of material to provide the necessary stability required from the retainer, while it sufficiently minimizes the production costs associated with the invention.

The holder 10 may be mounted by driving a screw, a nail, or the like, from the front side 32 through to the back side 34 and further driving the like into the surface thereby securing the holder 10. Preferably, at least two screws are used, but including more or less is not outside the scope of the present invention. Alternately, rather than using a nail or screw, the back of the affixing portion 14 of the bottle retainer 10 may further include an adhesive or magnetic material 36 configured to affix the bottle retainer 10 to the surface. One skilled in the art will readily realize numerous alternative methods for attaching portion 14 to a surface.

In an exemplary embodiment the bottle retainer 10 is made of plastic such as rigid polystyrene, as it is readily available, easily formed, and economically priced as their exist a wide range of plastic processors. In an even more preferred embodiment, the bottled holder will be manufactured by using an injection molding technique as is obvious to one of ordinary skill in the art. Other techniques readily known to one of ordinary skill, however, are not disclaimed and where appropriate should be incorporated herein.

The bottle retainer 10 may be placed in a variety of locations. As an example, the bottle retainer 10 may be secured in concealed locations, such as inside a cabinet, or in visible locations, such as on a counter, a refrigerator, etc.

The bottle retainer 10 may be further adapted to enable a user to configure various reference insignia about its surface, which may help to remind a user of medication times, dosages, and the like. Moreover, the present invention can be further modified by adding a timer or an alarm thereby enabling a user to seek a refill or at least make them aware that the medications contained therein are running low.

While the present invention has been particularly shown and described with reference to the foregoing preferred an alternative embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be present in this or a later application to any novel and non-obvious combination of these elements. The foregoing embodiments are illustrative, and no single feature or element is essential to all possible combination that may be claimed in this or a later application. Where the claims recite "a" or "a first" element of the equivalent thereof, such claims should be understood to include incorporation of one or more such elements, neither requiring nor excluding two or more such elements.

What is claimed is:

1. A retainer for securing and suspending a bottle having an upper portion that carries a cap and a lower portion, said retainer comprising:

a base having an affixing portion and a retaining portion, said affixing portion having a back side and a front side, said back side being adapted for mounting the retainer to a surface, at least two generally horizontal, substantially parallel arms, extending from the retaining portion to form at least one opening therebetween, said at least one openings having no covering members such that said opening has no obstructions, said at least one opening adapted to cooperate to suspend the lower portion of the bottle from the base, with the upper portion of the bottle adapted to be engaged by the arms to support a bottle within the at least one opening, wherein the arms are adapted to engage under the top portion in a groove defined between the lower portion and the cap, such that the lower portion is suspended beneath the retaining portion of the base; and wherein each of the arms has at least one obstruction positioned adjacent a forward edge of the arm and spaced away from the affixing portion, the at least one obstruction extending upwardly from a top surface of the am and being positioned on a portion of the arm on both sides of the at least one opening to resist accidental bottle disengagement, wherein the portion of the arm that the obstruction is positioned upon does not extend the entire width of the arm.

2. The retainer of claim 1, wherein said retaining portion comprises at least three, substantially parallel, generally horizontal arms, wherein said arms form at least two unobstructed openings for slidably receiving bottles therein.

3. The retainer of claim 2, wherein a first opening of said at least two openings is smaller than a second opening of said at least two openings.

4. The retainer of claim 2, wherein said at least two openings are equivalent in size.

5. The retainer of claim 2, wherein there are two obstructions positioned between adjacent openings, wherein each of said obstructions are positioned so as to be closer to one of said adjacent openings such that a gap is formed between adjacent obstructions.

6. The retainer of claim 1, wherein said back side of said affixing portion further includes an adhesive layer, adapted to mount the retainer to a surface.

7. The retainer of claim 1, wherein said affixing portion is adapted to receive at least one fastener for mounting the retainer to a surface.

8. The retainer of claim 1 wherein said obstruction has a cylindrical shape.

* * * * *